US005139256A

United States Patent [19]

Logan

[11] Patent Number: 5,139,256

[45] Date of Patent: Aug. 18, 1992

[54] BALL GAME AND NET THEREFOR

[76] Inventor: Kenneth A. Logan, 47 Reserve Rd., Beaumaris Vic. 3193, Australia

[21] Appl. No.: 684,907

[22] PCT Filed: Nov. 3, 1989

[86] PCT No.: PCT/AU89/00471

§ 371 Date: May 3, 1991

§ 102(e) Date: May 3, 1991

[87] PCT Pub. No.: WO90/05003

PCT Pub. Date: May 17, 1990

[30] Foreign Application Priority Data

Nov. 4, 1988 [AU] Australia ..... PJ 1301

[51] Int. Cl.[5] ..... A63B 61/00

[52] U.S. Cl. ..... 273/29 BG; 273/29 BD; 256/11

[58] Field of Search ..... 273/29 B, 29 BA, 29 BB, 273/29 BC, 29 BF, 29 BG, 29 BE, 29 BD; 256/11

[56] References Cited

U.S. PATENT DOCUMENTS

| | | | |
|---|---|---|---|
| 203,099 | 4/1878 | Zimmer | 256/11 |
| 243,696 | 7/1881 | Faloon | 256/11 |
| 349,686 | 9/1886 | Braithweite et al. | 273/29 BG |
| 401,082 | 4/1889 | Taylor | 273/29 BA |
| 906,848 | 12/1908 | Atwell | 273/29 BG |
| 1,210,541 | 12/1917 | Ryker | 256/11 |
| 1,300,972 | 4/1919 | Jassen | 273/29 BG |
| 1,526,126 | 2/1925 | FitzHerbert | 273/29 BF |
| 3,980,299 | 9/1976 | Brown | 273/29 BB |
| 4,065,099 | 12/1977 | Germain | 273/29 BE |
| 4,073,491 | 2/1978 | Sepaniac | 273/29 B |
| 4,119,301 | 10/1987 | Payne | 273/29 BD |
| 4,595,155 | 1/1986 | Gough | 273/29 BD |
| 4,976,432 | 12/1990 | Cheney | 273/29 B |

FOREIGN PATENT DOCUMENTS

| | | | |
|---|---|---|---|
| 6056 | of 1888 | United Kingdom | 273/29 BB |
| 11541 | of 1889 | United Kingdom | 273/29 BB |
| 23993 | of 1913 | United Kingdom | 273/89 BG |

*Primary Examiner*—Theatrice Brown

*Attorney, Agent, or Firm*—Dennison, Meserole, Pollack & Scheiner

[57] ABSTRACT

A net for a ball game comprising vertical end posts (1,2) and a vertical center post (3), a cross bar (7) extending between the end posts and the center post adjacent their upper ends to define the "height" of the net, a multiplicity of rows of net line (10) extending between each end post and the center post to provide a visible "net", the adjacent lines (10) being spaced sufficiently to allow a ball to pass when played at a level which is lower than the level of the net, the post (1,2,3) being hollow, the end posts receiving retaining member for the ends of the net lines (10), the center post (3) having a central rotatable tube (25) through which the net lines (10) pass, the net lines (10) being retractable within the center post (3) by rotation of the tube (25).

5 Claims, 3 Drawing Sheets

17
29
28
27
24
22
33
10
3
30
1
31
14
7
a
b
15
25
26
2
16
8
9
6
4
18
5

1
3
2
10
31
33
30
25
26
14
32

BALL GAME AND NET THEREFOR

Field of the Invention

This invention relates to a new ball game and to an improved net which may be used with the new ball game or with other games.

BACKGROUND OF THE INVENTION

Ball games such as tennis, while being extremely popular, have the disadvantage of requiring substantial space and capital cost in the establishment of a suitable court. Similarly, the standard tennis net, which does not allow a ball which strikes the net to carry through, is not totally suited to less formal or serious ball games of the type which may be played during limited leisure time and in a confined space.

Summary of Invention and Object

It is therefore the object of the present invention to provide a modified net which is more suited to less formal ball games and to provide a new ball game with which the net may be used.

In one aspect, the invention provides a demountable and portable net assembly comprising end posts and a centre post, at least one bar extending between the end posts and the centre post adjacent their upper ends to define the "height" of the net, said cross bar(s) being detachably secured to at least the end posts, and being supported by the centre post and a multiplicity of rows of net line extending between each end post and said centre post to provide a visible "net" through which a ball may pass when played at a level which is lower than the level of said at least one cross bar.

The net defined above may be easily assembled and disassembled, and by constructing the cross bar in two or more parts of convenient length, the components of the net may be easily carried in the boot or tank of a vehicle or conveniently stored when not in use.

Since the "net" portion of the net does not completely inhibit the passage of a ball through the net, any game played using the net requires less retrieval of the ball near the net and also provides each player with an improved view of the opponent's court.

In a preferred form of the invention, the net further includes a lower rail extending between each side post and the centre post and detachably secured thereto to increase the overall stability of the net structure.

The side posts and centre posts may be provided with an enlarged base on which each post stands. Alternatively, each post may be adapted to engage a hole or rigid sleeve defining a socket in the ground. Alternatively, a spike driven into the ground may engage a socket formed in the lower end of each post, or each post may carry a downwardly extending spike which is pushed into the ground at any position where a court can be defined.

In another aspect, the invention provides a ball game played with a bat or racquet and a ball, and a court having base lines and side lines divided by a net or equivalent barrier, each player or players having a service and receiving court defined by a transverse line positioned between the net and the base line, said game being played according to the following rules:

1. service of the ball to be effected from behind the base line;
2. points to be scored off a player's serve only;

3. service outside the service court or a ball hit outside the court or into the net by the server or serving team results in transfer of serve, and
4. the game is played for a predetermined period of time and the player leading at the expiry of time out wins, or the game is played until one player reaches a predetermined score.

BRIEF DESCRIPTION OF THE DRAWINGS

A preferred form of the net and court embodying the invention will now be described with reference to the accompanying drawings in which.

DESCRIPTION OF PREFERRED EMBODIMENT

Figure 1:
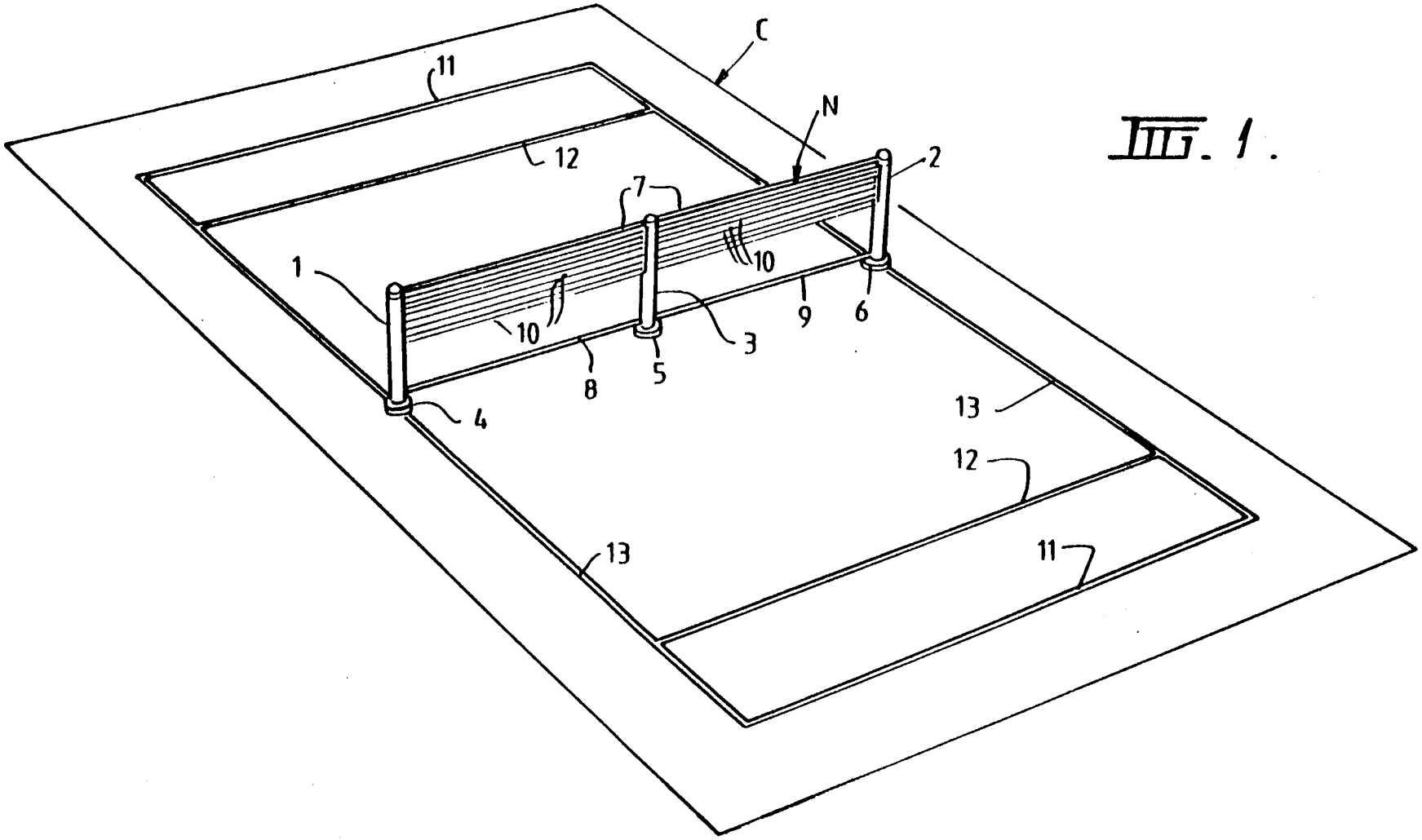
FIG. 1 is a perspective view of a court and net embodying the invention.

Referring firstly to FIG. 1 of the drawings, the net N embodying the invention will be seen to comprise a pair of end posts 1 and 2 and a centre post 3, each having a support base 4, 5 and 6, a top rail 7, bottom rails 8 and 9 extending between the end posts 1 and 2 and the centre post 3, and a multiplicity of net lines 10 extending between the end posts 1 and 2 and the centre post 3.

Figure 2:
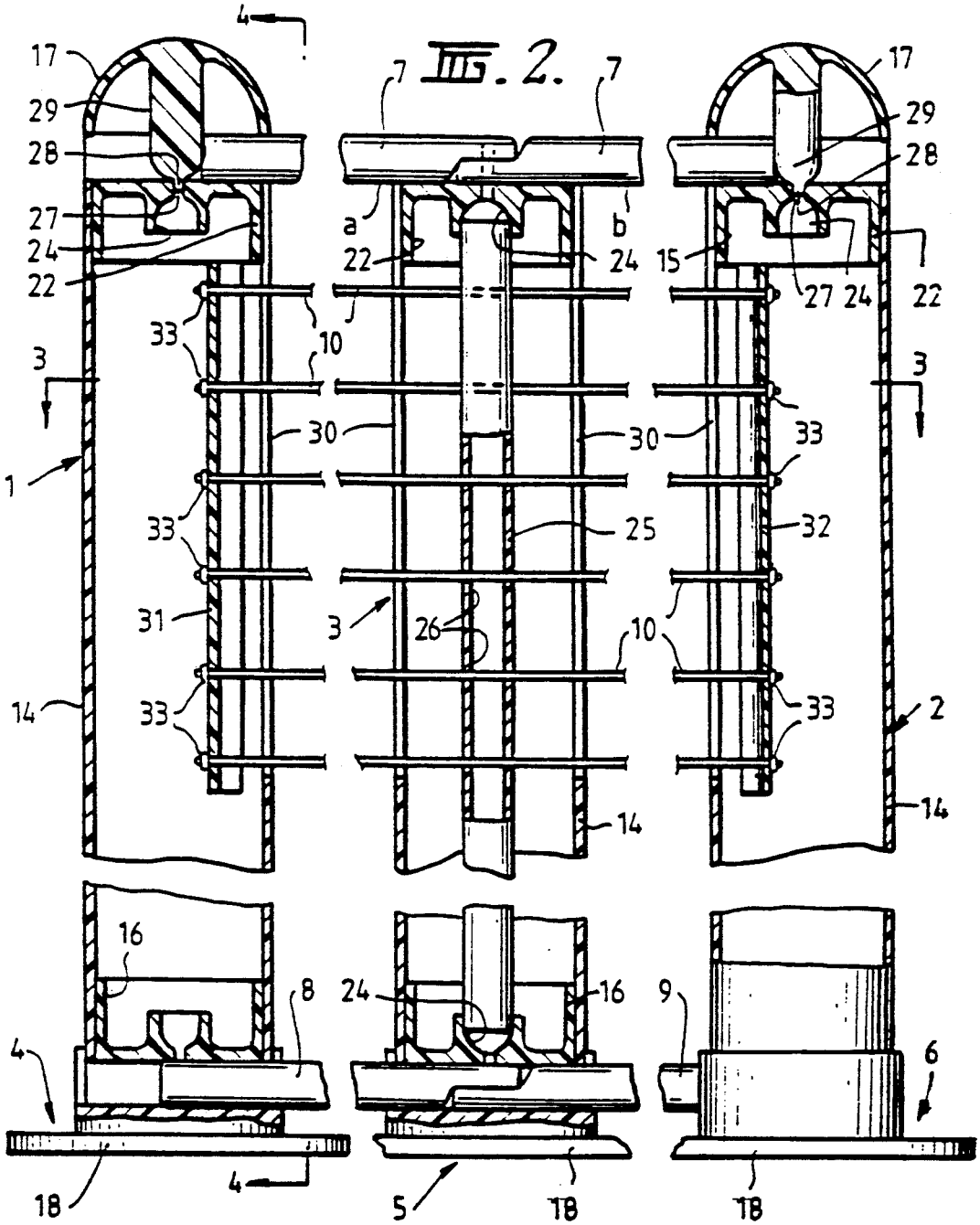
FIG. 2 is an enlarged sectional elevation of the net showing the internal details of the end posts and centre posts of the net.

The top rail 7 is preferably made in at least two connected tabular pieces a and b for ease of transport or storage, and the end portions are flattened, as shown in FIG. 2, to overlap in the groove in the top of the centre post 3, where they may be pinned together or to the top of the post 3. The pieces a and b may each comprise two pieces connected by a connecting element (not shown) having end portions which engage in the ends of the tubes defining the pieces a and b, if desired, or by turning one end of one piece with a thread and attaching a threaded socket to the other end of the other piece (not shown), to further reduce the length of the pieces a and b. The bottom rails 8 and 9 may be made in the same way.

The court C on which one game embodying the invention may be played will be seen to include base lines 11, service court lines 12, side lines 13 and a net N arranged in the centre of the court C. In one form of the game embodying the invention, the court C is about 4 m wide by about 8 m long although these dimensions may be modified to suit the player's purposes.

Figure 4:
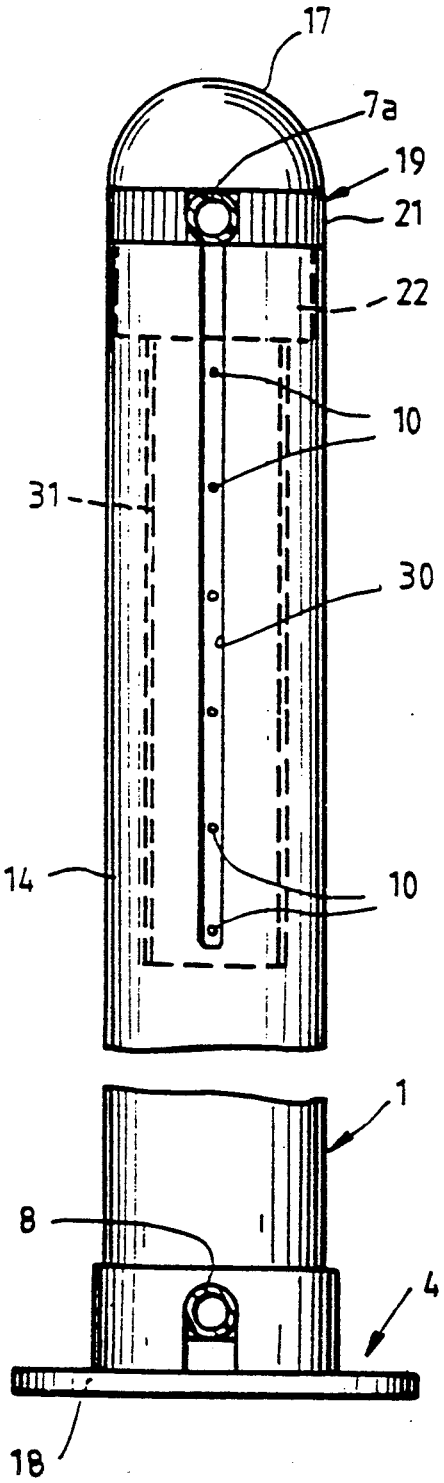
FIG. 4 is a side elevation of one end post.

As shown more clearly in FIGS. 2 and 4, each side post 1, 2 comprises a central plastics tube 14 closed by a pair of moulded end pieces 15 and 16, a cap member 17 attached to the end piece 15 and a plate member 18 attached to the end piece 16 to define the support bases 4 and 6. The centre post 3 is similarly constructed and like reference numerals indicate like parts.

Figure 6:
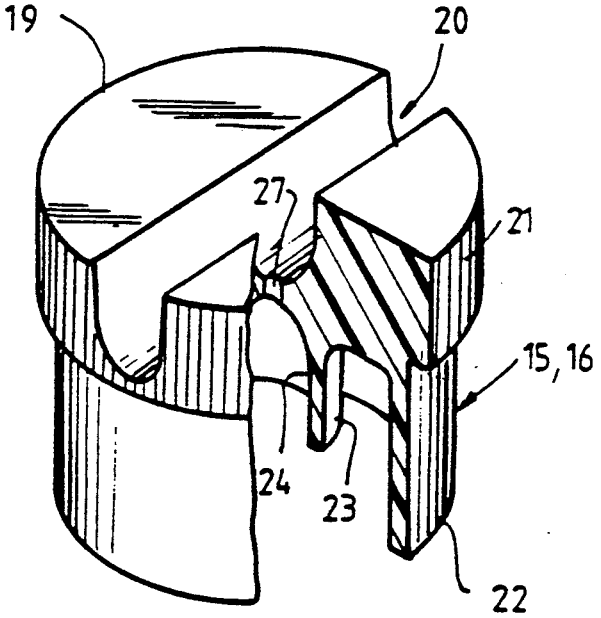
FIG. 6 is a fragmentary perspective view of a moulded end piece of the posts.

As reference to FIG. 6 of the drawings will show, each end piece 15, 16 comprises a cylindrical head portion 19 formed with a transverse groove 20 dimensioned to receive the top rail and bottom rails 7, 8 and 9 and having a ribbed peripheral surface 21 to enable the end piece 15 of the centre post 3 to be manually rotated for a purpose to be described below. A depending cylindrical skirt 22 of smaller diameter than the head portion 19 extends from the lower face of the head portion 19 and is dimensioned to be received as a neat fit within the ends of the tubes 14. A further smaller cylindrical skirt 23 depends centrally from the head portion 19 within the skirt 22 and defines a cylindrical socket 24 which is dimensioned to receive a tube 25 through which the net lines 10 are attached, passing through aligned holes 26 (FIG. 3) formed in the tube 25. The upper end of the tube 25 is fixed to the top end piece 15, say be gluing, so that when the head portion 19 is manually rotated, the tube 25 also rotates.

The socket 24 also has a central opening 27 which opens into the groove 20 to define a location opening for a central spigot 28 extending from the end of a downwardly depending central locating member 29 forming part of each cap 17. The cap 17 may be secured in place by means of gluing.

Figure 3:
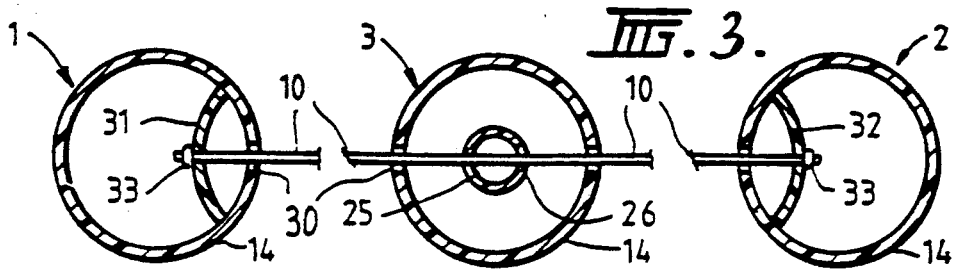
FIG. 3 is a sectional plan view of the net further showing the internal details of the end posts and centre post.

The net lines 10 preferably comprise elements of thin plastics tubing which pass through elongate slots 30 formed in the tubes 14 defining the end post 1 and 2 and the centre post 3. The net lines 10 are held in the end post 1 and 2 by means of arcuate plastics plates 31 and 32 which are located, as shown in FIGS. 2 and 3 of the drawings, within the tubes 14 defining the end post 1 and 2. The ends of the net lines 10 are held captive with the arcuate plates 31 and 32 by means of plastics collects 33, which may be bonded, glued or heat shrunk onto the net lines 10 in a known manner. A spacing of about 45 mm between adjacent lines 10 is preferred to allow the ball used in the game to pass through the net.

Figure 5:
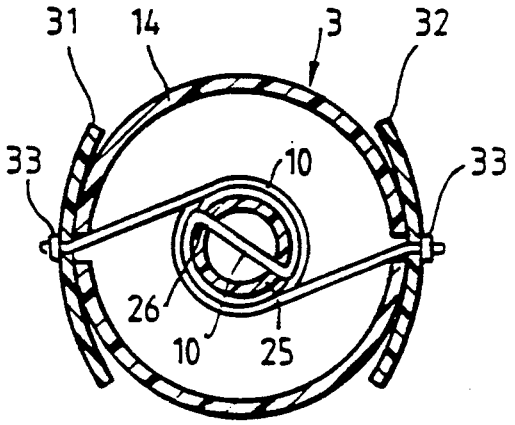
FIG. 5 is a sectional plan view of the centre post showing the net in the 'stored' condition.

When the net embodying the invention is to be dismantled for storage or transport, the elements of the top rail 7 are removed from the grooves 20 in the end post 1 and 2 and the centre post 3 and the end pieces 15 and attached caps 17 are removed from the end post tubes 14. The arcuate plates 31 and 32 may then be slid out of the end post tubes 14 through the slots 30 and the end piece 15 of the centre post 3 rotated to wind the net lines 10 into the centre post tube 14 around the tube 25, in the manner shown in FIG. 5 of the drawings. Alternatively, the arcuate plates 31 and 32 may be left in the end post tubes 14 and the end posts drawn towards the centre post 3 as the net lines 10 are retracted into the centre post 3 by rotation of the moulded end piece 15.

It will be appreciated from the above, and particularly from FIG. 1, that the net embodying the invention has somewhat more appealing lines than a standard tennis net, and since it is far more open than the standard net, it not only allows a ball to continue on its path after contact with the net, negating the need for retrieval at the net, but also enhances each player's view of the opponent's court. The net may be quickly and easily assembled and disassembled and is capable of being manufactured as an inexpensive alternative to tennis and other nets currently available.

Referring again to FIG. 1, one game which may be played using the net and court shown is in accordance with the following rules:

1. service of the ball to be effected from behind the base line;
2. points to be scored off a player's serve only;
3. service outside the service court or a ball hit outside the court or into the net by the server or serving team results in transfer of serve, and
4. the game is played for a predetermined period of time and the player leading at the expiry of time out wins, or the game is played until one player reaches a predetermined score.

A bat and "semi-soft" ball of the type used to play "racket ball" may be used in this game. The bat may be a simple wooden bat having a multiplicity of holes in the head of the bat to reduce weight and wind resistance, or may be a standard wooden or plastics "paddle". The ball may be a commercially available "racketball" ball, although it should be appreciated that games may be played using the net and court to be described below using any suitable type of bat, racquet or ball, including a standard tennis racquet and ball or a so-called "Half-Court" racquet and ball.

In a preferred form of the game, service is determined by the toss of a coin, both feet are to be behind the base line during service, and the transverse lines defining the service courts are positioned a short distance ahead of the base line.

The score increases in single units, the winner being the player with the highest points when time out occurs or who first reaches a predetermined score with a predetermined lead. Other rules governing the playing of this game are similar to tennis, with the exception that there are no "faults" on service. Any "fault" results in the transfer of service to the opponent.

In a presently preferred form of the game, the game is played for a predetermined period, such as exactly ten minutes. When time out occurs, the player who is leading wins the game irrespective of whether play is in progress when time out occurs. Alternatively, the game may be played on the basis that the first player who reaches a score of nine and is two points ahead of the opponent wins the game.

It will be appreciated from the foregoing description of the new ball game according to to the invention, that the game has elements of tennis, table tennis and badminton, is played on a court requiring only a limited area and with a net which allows the ball to carry through and greater visibility of the opponent's court. Thus, the game may be played in a confined space, it may be played inside or outside, it may be played by players of a wide range of ages, from children to elderly, and may be played in a short time span, which makes it suitable for playing during lunchtime periods and the like.

Since the court on which the game may be played is relatively small, it should be possible for the game to be played in most residential backyards. Similarly, the game may be played at hotels, motels, caravan parks and industrial complexes. Alternatively, it would be possible to erect a large number of courts in a commercial stadium.

By using a "soft" ball or a "semi-soft" ball, the game may be played on an outside grass surface or on an inside artificial grass or more rigid surface. By the use of small court, small bats and "semi-soft" balls, the game may be played by young and old increasing the appeal of the game as a social game not requiring particular strengths or skills. By the use of the single score point system and predetermined time for the playing of a game as outlined above, several games may be played during a lunch period or during a predetermined booked time. The game also allows for a "round-robin" series for competition.

I claim:

1. A demountable and portable game net assembly comprising vertically extending hollow end posts and a vertical hollow centre post, at least one cross bar extending between the end posts and the centre post adjacent their upper ends to define the "height" of the net, said cross bar(s) being detachably secured to at least the end posts, and being supported by the centre posts and a multiplicity of rows of net lines extending between each end post and said centre post to provide a visible "net" through which a ball may pass when played at a level which is lower than the level of said at least one cross bar, said net lines being attached to a vertically extending elongated rotatable element arranged within said center post, said net lines having free ends, said free ends of said net lines being attached to releasable restraining means located within said end posts, upon release of said releasable restraining means from said posts said net lines are capable of being wound into said center post and around said elongated rotatable element by rotation of said rotatable element for net storage purposes.

2. The net of claim 1, further including a lower rail extending between each side post and the centre post and detachably secured thereto to increase the overall stability of the net structure.

3. The net of claim 2, wherein each side post and centre post is provided with an enlarged base on which each post stands and the spacing between adjacent rows of net line is about 45 mm.

4. The net of claim 1, wherein each hollow tubular post is closed by moulded end pieces, each moulded end piece having a transverse groove receiving rail elements and having a depending skirt received within said tubular members and a central socket receiving an end of said rotatable element.

5. The net according to claim 4, wherein said releasable restraining means are arcuate plates, said free ends of said net lines being attached to said arcuate plates received within said end posts, said arcuate plates being removable from said end posts to engage the outer surface of said centre post when the net lines are wound within said centre post.

* * * * *